United States Patent [19]

Baseggio et al.

[11] Patent Number: 4,669,280

[45] Date of Patent: Jun. 2, 1987

[54] CAMHOLDER FOR A FLAT-BED KNITTING MACHINE AND KNITTING MACHINE EQUIPPED WITH SUCH A CAM HOLDER

[75] Inventors: Marcello Baseggio, Ollon; Gérard Steiger, Bouveret; Louis P. Frund, Monthey, all of Switzerland

[73] Assignee: Atelier de Construction Steiger S.A., Switzerland

[21] Appl. No.: 902,173

[22] Filed: Aug. 29, 1986

[30] Foreign Application Priority Data

Sep. 4, 1985 [EP] European Pat. Off. ..... 85201387.9
Mar. 7, 1986 [CH] Switzerland ..... 947/86

[51] Int. Cl.[4] ..... D04B 7/00
[52] U.S. Cl. ..... 66/78
[58] Field of Search ..... 66/75.1, 75.2, 78, 70

[56] References Cited

U.S. PATENT DOCUMENTS 3,614,878 10/1971 Mas ..... 66/78
4,287,727 9/1981 Otoshi ..... 66/78
4,463,379 8/1984 Schimko et al. ..... 66/75.1
4,470,274 9/1984 Shima et al. ..... 66/75.1
4,616,488 10/1986 Schmodde ..... 66/70

*Primary Examiner*—Ronald Feldbaum
*Attorney, Agent, or Firm*—Kane, Dalsimer, Kane, Sullivan and Kurucz

[57] ABSTRACT

The camholder possesses at least one section having an axis of symmetry (A) passing through the center of a first sinker selection cam (14) and through the center of a needle transfer cam (25). The transfer cam (25) is retractable by means of a control device. Arranged on either side of the axis of symmetry (A) are sinker selection cams (15, 16), taker-up cams (17, 18), loom-style cams (19, 20) and transfer and receiving cams (21, 22). All these cams, arranged between the selection cams, are automatically retractable. The camholder has a single type of drop, and it makes it possible in one and the same drop to carry out both knitting and stitch transfer forwards or backwards and in both directions of movement of the carriage.

6 Claims, 10 Drawing Figures

CAMHOLDER FOR A FLAT-BED KNITTING MACHINE AND KNITTING MACHINE EQUIPPED WITH SUCH A CAM HOLDER

FIELD OF THE INVENTION

The present invention relates to a camholder for a flat-bed knitting machine according to the preamble of claim 1.

PRIOR ART

Such a camholder is described, for example, in French Pat. No. 2,438,105. This camholder has, over its length, four sections or drops with specific functions. At the center of the camholder there are two knitting sections, and at each of the ends of the camholder there is a transfer section used to carry out a stitch transfer. This camholder is intended for working with an individual key selection system controlled electronically and carried by the carriage. It makes it possible, during each passage of the carriage, for any needle to work at either formation, taking-up or forward or backward transfer. However, when a needle works at knitting (formation or taking-up), it is necessary to jump over the transfer sections, that is to say the length of the camholder corresponding to these transfer sections is not used during the travel of the carriage. On the other hand, the preselection necessary for carrying out a transfer takes place at the outlet of the camholder, the transfer occurring during the return of the camholder. Finally, when the selection is programmed, it is necessary to take into account the position of the section on the camholder.

Similar camholders are also known from the documents DE-B-No. 1,760,025 and FR-A-No. 2,075,791.

It has already been proposed to produce a camholder which has a single type of section or drop capable of performing all the desired functions, in particular stitch transfer forwards or backwards in both directions of movement of the camholder carriage (GB-A-No. 2,106,940). This camholder nevertheless has a large number of controlled movable cams requiring a corresponding number of control devices. It possesses, in particular, pairs of cams alternately in action and out of action, which have to be controlled by means of limit stops, thus making it necessary to operate with a fixed travel of the carriage. But some of the travel is often left unused. Moreover, the control of the needles is concentrated at one and the same level, and the butts of the needles support all the forces necessary for the movement of the needles. The risks of fracture are high where some functions are concerned, especially when working at high speed.

SUMMARY OF THE INVENTION

The object of the present invention is to provide a camholder which likewise has a single type of section or drop capable of performing all the desired functions, but which possesses a minimum number of controlled cams and makes it possible to work at high speed and with a variable travel of the carriage.

This object is achieved by means of the camholder according to the invention, as defined in claim 1.

In this camholder, only the giving transfer cams are controlled. The work is distributed between the sinkers and the needles. The sinker selection cams are separated by a wide space which makes it easier to select the sinkers between these cams without the risk of fracture. There is no need to ensure the cam path of the butts of the sinkers by means of controlled cams, but instead these butts make their own way by means of retractable cams.

The invention also relates to a flat-bed knitting machine, such as that defined in claim 2.

DESCRIPTION OF THE PREFERRED EMBODIMENTS

Figure 1:
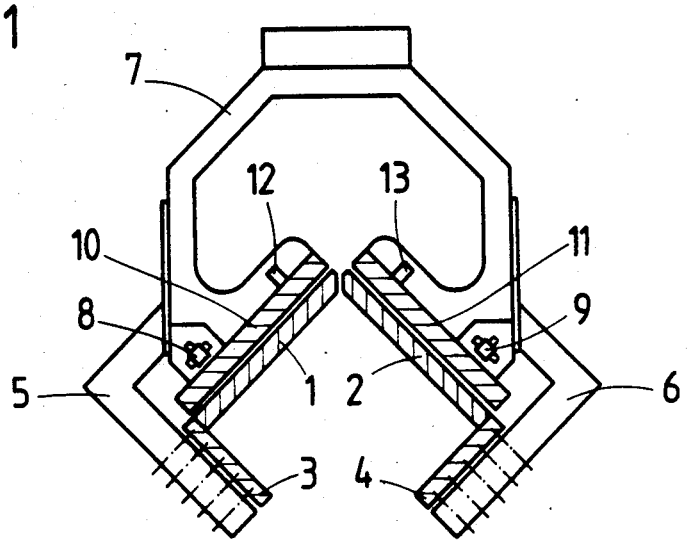
FIG. 1 shows, as a reminder, a diagrammatic sectional view through the beds of a flat-bed knitting machine.
Figure 2:
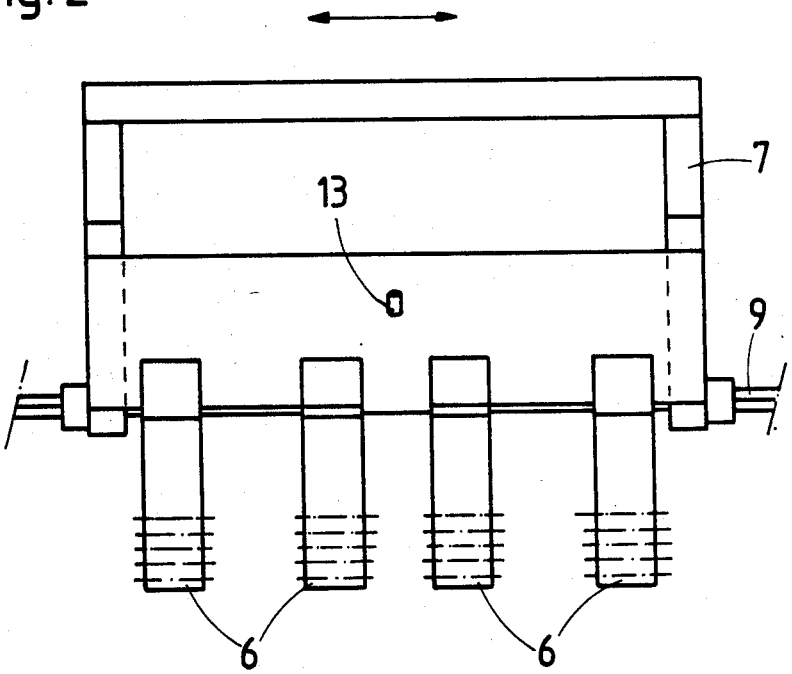
FIG. 2 is a diagrammatic side view of the carriage of the machine illustrated in FIG. 1.

FIGS. 1 and 2 show diagrammatically, as a reminder, a flat-bed knitting machine comprising two beds 1 and 2 which form a dihedron and in the grooves of which are arranged needles and sinkers or pushers interacting with these needles. Fastened to the bottom of each of the beds 1 and 2 are auxiliary beds 3 and 4 which are at right angles to the main beds and in which are seated auxiliary sinkers associated with the sinkers of the beds 1 and 2 and interacting with electromagnetic selection devices 5 and 6 integral with a carriage 7 which moves above the beds 1 and 2 on rails 8 and 9 and which mainly carries two camholders 10 and 11. The selection devices 5 and 6 are described in detail in Swiss Pat. No. 632,024. It should be remembered that the auxiliary sinkers are mounted on springs, and that they have a fork, in which the rear end of the main sinkers is engaged, the assembly as a whole being such that the main sinkers are selected when the auxiliary sinkers, first laid down by a cam, are not retained by one of the elements of the selection device, but are lifted under the effect of their springs, at the same time driving the corresponding main sinker, the butt of which is then driven by a selection cam of the camholder.

The camholders 10 and 11 also carry electromagnetic devices 12 and 13 which control the transfer cams, in such a way that these cams can be operative by projecting from the camholder or inoperative by being embedded in the camholder. Such a device can be, for example, the device described in detail in Swiss Pat. No. 635,378.

The camholders according to the two embodiments, as illustrated in FIG. 2, carry a camholder with a single drop and four selection devices 6.

Figure 3:
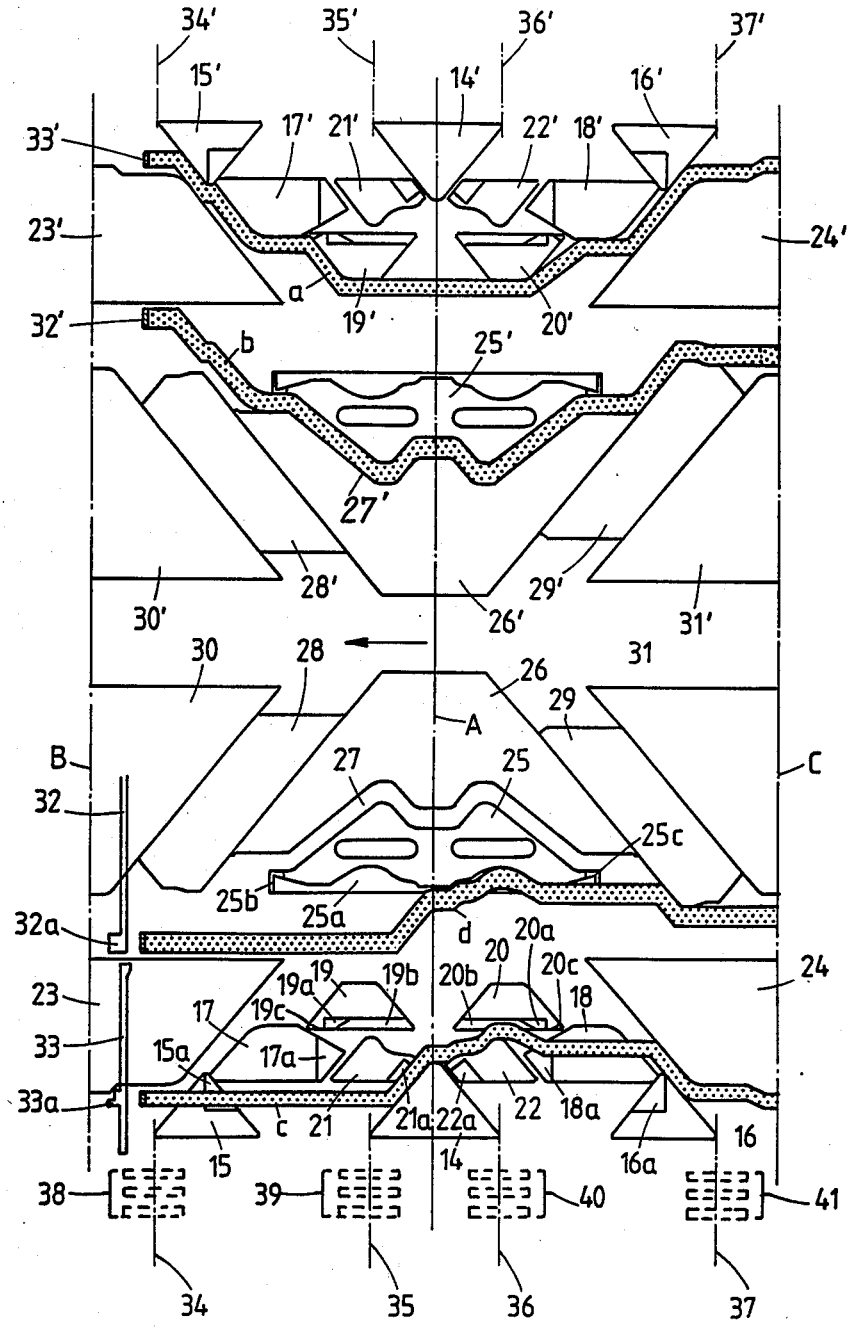
FIG. 3 is a plan view of the two camholders according to a first embodiment, showing the path of the needles working at transfer.

The camholder according to the first embodiment, as illustrated in FIG. 3, comprises a first sinker selection cam 14 arranged in the center of the camholder, a second selection cam 15 and a third selection cam 16 which are arranged on each side of the selection cam 14 at a certain distance from the latter, these three selection cams being fixed, two automatically retractable taker-up cams 17 and 18 arranged on each side of the selection cam 14 between the selection cams, two retractable loom-style cams 19 and 20 arranged on each side and above the selection cam 14, two automatically retractable transfer cams 21 and 22 arranged on each side of the selection cam 14, two sinker laying-down cams 23 and 24 arranged on each side of the selection cam 14, a transfer cam 25 arranged in the center of the camholder above the selection cam 14, this cam 25 being retractable by means of one of the devices 12 or 13, a fixed cover cam 26 located above the transfer cam 25 and defining, with this cam 25, a channel 27 for the butt of the needles working at transfer (giving needles), two conventional knitting or drop cams 28 and 29 on each side of the cover cam 26, and two conventional alignment cams 30 and 31 arranged on either side of the knitting or drop 28 and 29. Thus, only the transfer cam 25 is controlled.

The cams automatically retractable by means of the sinkers have respective slopes 17*a*, 18*a*, 19*a*, 20*a*, 21*a* and 22*a*. When the butt of a selected sinker meets one of these slopes, it pushes the corresponding cam back into the camholder by compressing a spring, on which the said cam is mounted, and can thus continue its path without being driven by this cam. The cams 15 and 16 likewise have respective slopes 15*a* and 16*a*, but since these cams are fixed these slopes serve not to retract the cams, but to allow the butts of the unselected sinkers to pass after the auxiliary sinkers have been released by means of the selection device.

The needles 32 and sinkers 33 have been shown in profile on the left in the drawing, that is to say in a position folded down relative to their true position and in the position of rest. The true position of the needles and of the sinkers has been shown, for one of these, only by its respective butt 32*a* and 33*a*. The positions of the selection devices 6 is indicated, on the one hand, by the axes of symmetry 34, 35, 36 and 37 of these selection devices and, on the other hand, by the first three pawls 38, 39, 40 and 41 of each of the selection devices, these pawls being intended for retaining the unselected auxiliary sinkers in the lower position, as described in Swiss Pat. No. 632,024.

Figure 5:
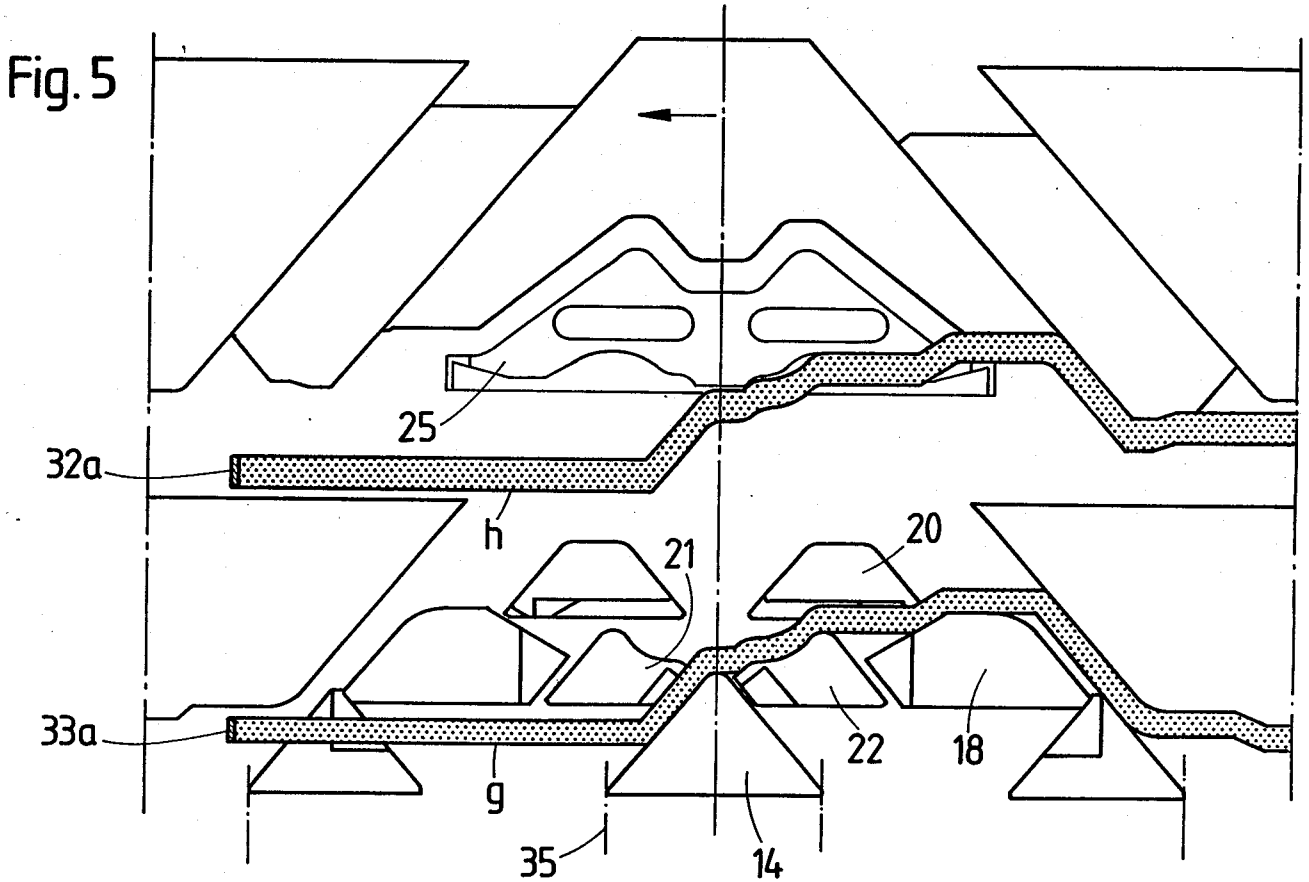
FIG. 5 shows, on the same camholder, the path of the sinkers and needles working at taking-up.
Figure 6:
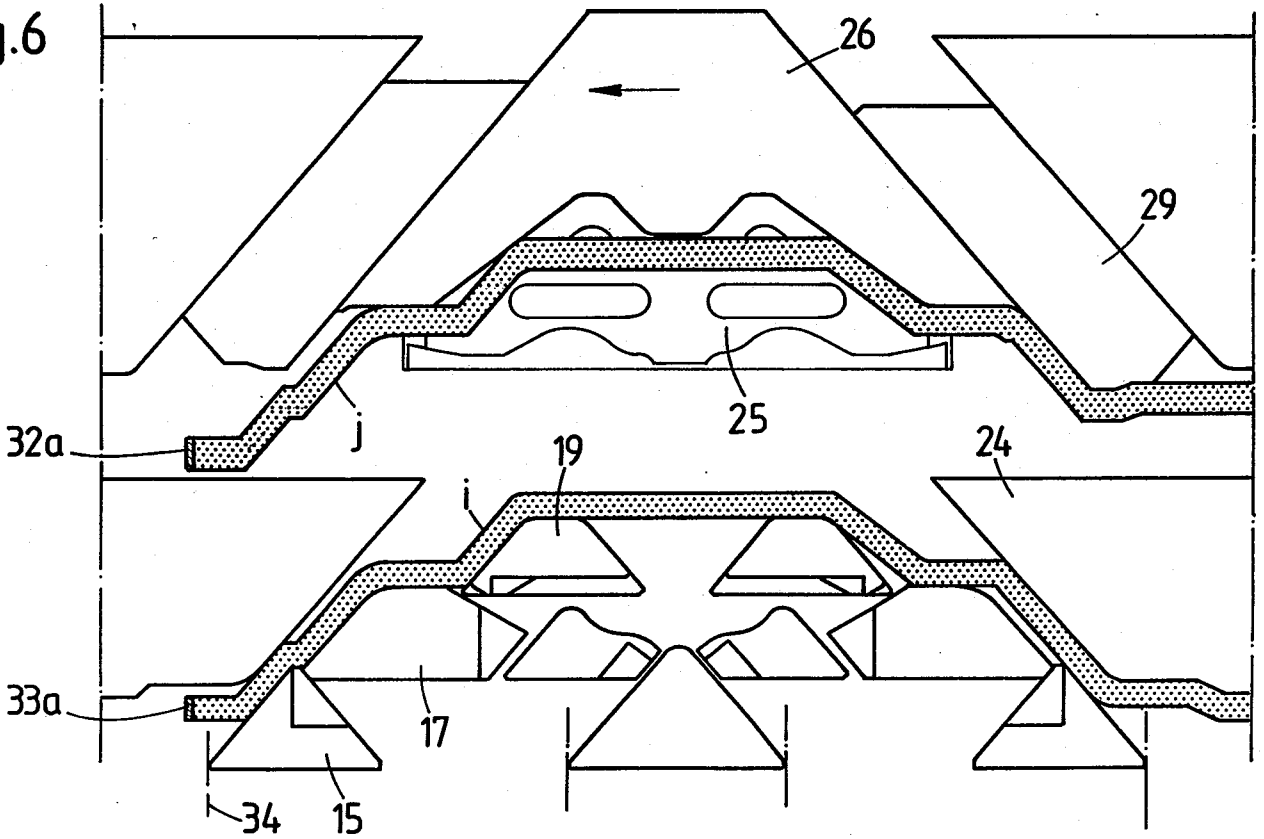
FIG. 6 shows, on the same camholder, the path of the sinkers and needles working at formation.

To make it easier to understand the drawing, it is expedient to point out that the cam parts 19*b*, 20*b* and 25*a* are recessed parts. The cams 19 and 20 also have, at their outer ends, a clearance 19*c*, 20*c* for the passage of the butt 33*a* of the sinkers, more specifically the lower half of these butts, the upper part at a lower level passing above the cam 19 or 20 during taking-up, as can be seen in FIG. 5. Moreover, the cam 25, at each of its ends, possesses a safety slope 25*b* and 25*c*, these safety slopes being intended to prevent the fracture of the needle butt which happened to accidentally come up against the end of the transfer cam 25.

It will be noted that the camholder illustrated has an axis of symmetry A passing through the center of the selection cam 14 and the center of the transfer cam 25. In general, the camholder will consist of several sections (drops) identical to the section shown. This is indicated by the two dot-and-dash lines B and C which are likewise axes of symmetry between two adjacent sections. The number of sections or drops capable of being placed end to end in this way is limited only by the length of the knitting machine.

The various possibilities of selection in the camholder section illustrated will be described with reference to FIGS. 3 to 6.

FIG. 3 indicates the paths of the butts of a sinker and of the needle associated with it for stitch transfer work, the giving needle 32′ being in the rear bed and being driven by the rear camholder shown in the upper part of FIG. 3, whilst the receiving needle 32 works with the front camholder shown in the lower part of the drawing. Of course, the rear camholder is identical to the front camholder, and its cams have been designated by the same reference numerals bearing an ′. It is nevertheless directly possible to reverse the functions or consider the reflected image of FIG. 3, which means that the transfer can also be carried out from front to rear and from left to right or right to left. In the example illustrated, it is assumed that the carriage moves from right to left, that is to say in the direction of the arrow. The sinker 33′ is selected first in front of the selection cam 15′. It is driven by this selection cam 15′ and the cams 17′ and 19′ according to the path a and is then laid down at the end by the laying-down cam 24′. The associated needle 32′ is driven by the sinker 33′ and is then received by the channel 27′, in order to carry out the transfer according to a conventional path b. In the front bed, the sinker 33 associated with the needle 32 receiving the stitch is selected only in front of the selection cam 14, and its butt is lifted by this cam 14, at the same time pushing back the cam 21 during its passage, and then by the cam 22 according to a path c. The needle 32 associated with it is driven by the sinker according to a path d, and its butt is then picked up by the transfer cam 25 in order to receive the transfer stitch. The sinker 33 in turn is driven to the rear by the needle 32, and its butt pushes back the retractable cam 18 before being laid down by the cam 24.

Figure 4:
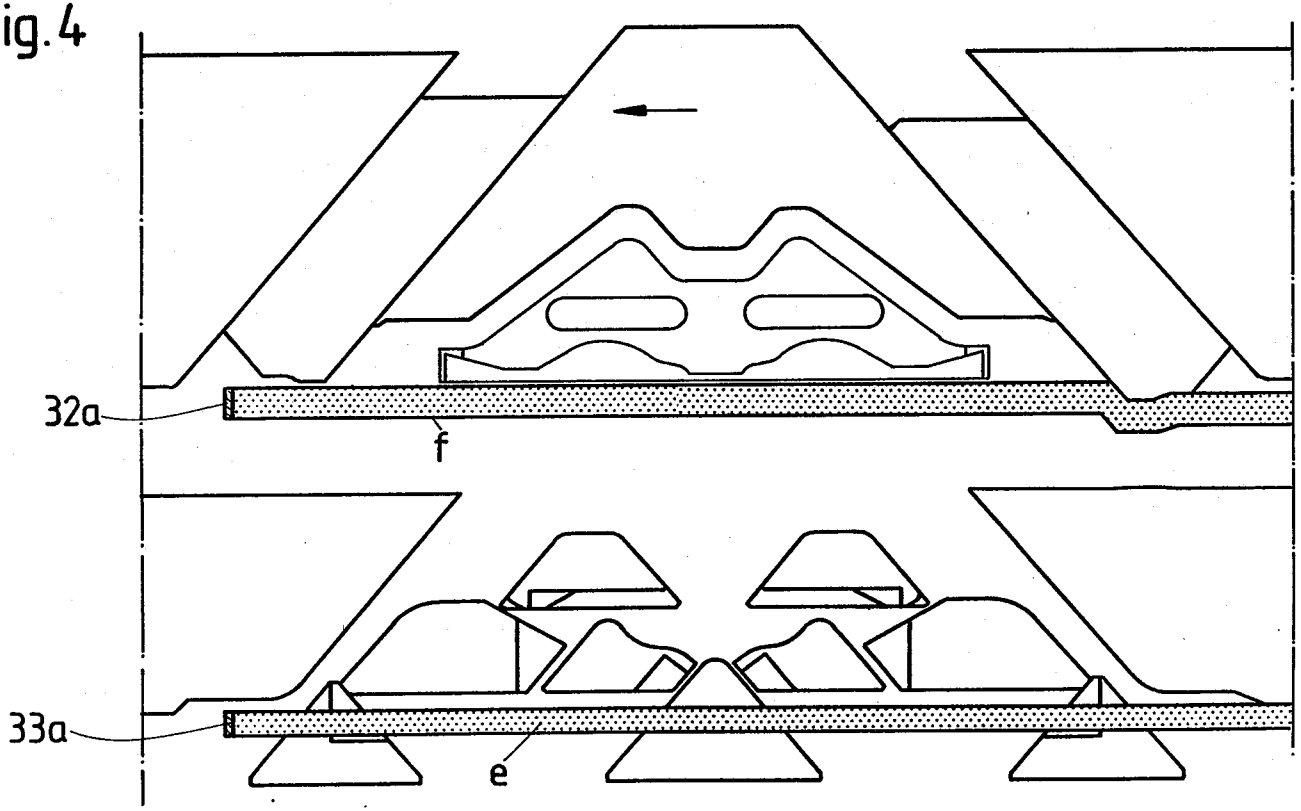
FIG. 4 shows the path of the sinkers and needles out of action on one of the camholders of this first embodiment.

If the sinker is not selected, its butt 33*a* is embedded in the groove of the bed, and it is not driven by the selection cams, as illustrated in FIG. 4 by the path e. The butt 32*a* of the associated needle then follows a path f, that is to say this needle is inoperative.

If a needle is to work at taking-up, its sinker is selected in front of the selection cam 14 (FIG. 5). Its butt is driven by the cams 14, 22 and 18, and in passing it pushes back the cam 20 according to a path g. The needle associated with it is driven by this sinker according to a similar path h, the transfer cam 25 being retracted.

If a needle is to work at formation, its sinker is selected in front of the selection cam 15, and its butt 33*a* is driven by this cam 15 and by the cams 17 and 19 according to a path i. The needle associated with it follows a path j similar to the path i, the transfe[cam 25 being retracted. The needle and its sinker are subsequently driven respectively by the cam 26, the drop cam 29 and the sinker laying-down cam 24.

When the carriage moves in the other direction, the selections are made respectively at 36 for transfer and taking-up and at 37 for formation.

Figure 7:
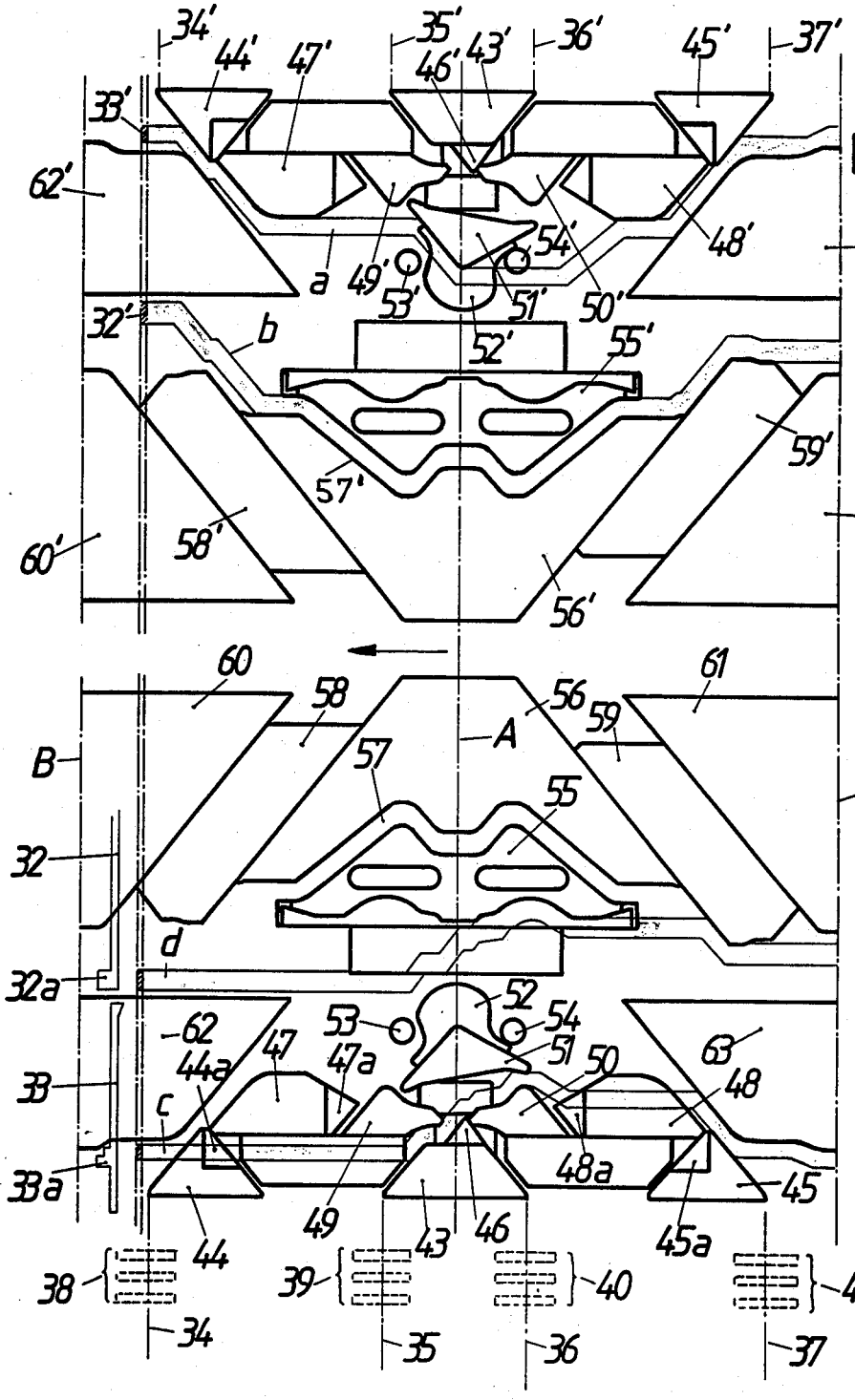
FIG. 7 is a plan view of the two camholders according to a second embodiment, showing the path of the needles working at transfer.

The camholder according to the second embodiment, as illustrated in FIG. 7, comprises a first selection cam 43 intended for selecting the sinkers and arranged in the center of the camholder, a second selection cam 44 and a third selection cam 45 arranged on each side of the selection cam 43 at a certain distance from this cam 43. The selection cam 43 is in two parts, namely a fixed trapezoidal lower part and a movable triangular upper part 46 capable of moving transversely, that is to say from right to left or in the opposite direction when it meets the butt of a sinker. The other two selection cams 44 and 45 are fixed, but each have a slope 44*a* and 45*a* serving not to retract the cams, but to allow the butts of the unselected sinkers to pass after the auxiliary sinkers have been released by means of the selection device, as described in Swiss Pat. No. 632,024.

Arranged a little higher than the selection cams 43, 44 and 45 and on each side of the central selection cam 43 are two taker-up cams 47 and 48. These cams are automatically retractable by means of the sinkers and for this purpose each have a slope 47*a*, 48*a*. On each side of the movable cam 46 are arranged two fixed transfer cams 49 and 50 which also serve as stops for the cam 46 to limit its stroke. Located exactly above the selection cam 43 and the transfer cams 49 and 50 is a triangular cam 51 mounted pivotally on the camholder. This pivoting cam 51 is integral with a support 52 set back from the cam 51 and allowing the cam 51 to pivot about an axis passing through the apex of the triangle. At rest, the cam 51 occupies the position shown in FIG. 8, in which the lower side of this cam is horizontal. Under the effect of the butts of the sinkers, it can tilt towards one side or the other, this tilting being limited by two stops 53 and 54 arranged on either side of the support 52. Located above the pivoting cam 51 is a transfer cam 55 retractable by means of the device 12 or 13 and a fixed cover cam 56 which, with the transfer cam 55, defines a channel 57 for the butt of the needles working at transfer (giving needles). On each side of the cover cam 56 there are two conventional alignment cams 60 and 61 arranged on either side of knitting or drop ams 58 and 59. This camholder therefore has only two pairs of retractable cams instead of six pairs according to the first embodiment. The noise is thereby reduced substantially.

The needle 32 and the sinkers 33 have been shown in profile on the left in the drawing, that is to say in a position folded down relative to their true position and in the position of rest. The true position of the needles has been shown, for one of these, only by the respective butts 32*a* and 33*a*. The position of the selection devices 6 is indicated, on the one hand, by the axes of symmetry 34, 35, 36 and 37 of these selection devices and, on the other hand, by the first three pawls 38, 39, 40 and 41 of each of the selection devices, these pawls being intended for retaining the unselected auxiliary sinkers in the lower position, as described in Swiss Pat. No. 632,024.

It will be seen that the camholder illustrated has an axis of quasi-symmetry A passing through the center of the selection cam 43, of the pivoting cam 51, of the transfer cam 55 and of the cover cam 56. In general, the camholder will consist of several sections (drops) identical to the section shown. This is indicated by the two dot-and-dash lines B and C which are likewise axes of symmetry between two adjacent sections. The number of sections or drops capable of being placed end to end in this way is limited only by the length of the knitting machine.

The various possibilities of selection in the camholder section illustrated will be described below by means of FIGS. 7 to 10.

FIG. 7 indicates the paths of the butts of a sinker of the needle associated with it for stitch transfer work, the giving needle 32′ being in the rear bed of the machine and being driven by the rear camholder shown in the upper part of FIG. 3, whilst the receiving needle 32 works with the front camholder shown in the lower part of the drawing. Of course, the rear camholder is identical to the front camholder, and its cams have been designated by the same reference numerals bearing the symbol ′. It is nevertheless directly possible to reverse the functions or consider the reflected image of FIG. 7, which means that the transfer can also be carried out from front to rear and from left to right or right to left. In the example illustrated, it is assumed that the carriage moves from right to left, that is to say in the direction of the arrow. The sinker 33′ is selected first in front of the selection cam 44′. It is driven by this selection cam 44′ and by the taker-up cam 47′ according to the path "a", at such a height that its butt comes up against one of the sloping flanks of the pivoting cam 51′ which pivots about its apex. The needle 32′ associated with it is driven by the sinker and is then picked up by the channel 57′ in order to carry out the transfer according to a conventional path "b". When the needle descends in the channel 57′ again, it drives the sinker 33′ to the rear, and this sinker is finally laid down by the laying-down cam 63′.

In the front bed, the sinker 33 associated with the needle 32 receiving the stitch is actuated only in the position 35 just in front of the central selection cam 43. Its butt first comes up against the rounded lower edge of the transfer cam 49, thereby pushing the triangular movable cam 46 laterally to the right, in such a way that the butt of the sinker can rise along this cam 46 so as to come onto the second transfer cam 50, against the end of which the movable cam 46 has come to rest. During this ascent, the pivoting cam 51 used in the other bed and also during formation, as will be described later, pivots under the thrust of the butt of the sinker 33, so as to allow the needle driven by the sinker to pass according to a path "d", and its butt is then picked up by the transferred lower flank. During its return movement, the needle 32 drives the sinker 33, and the butt 32*a* of the latter pushes back the taker-up cam 48 by means of its slope 48*a*, finally being laid down by the laying-down cam 63.

The use of a pivoting cam 51 makes it possible to reduce the number of cams by omitting two loom-style cams and to have fixed cams 49 and 50. The construction is thereby simplified.

Figure 8:
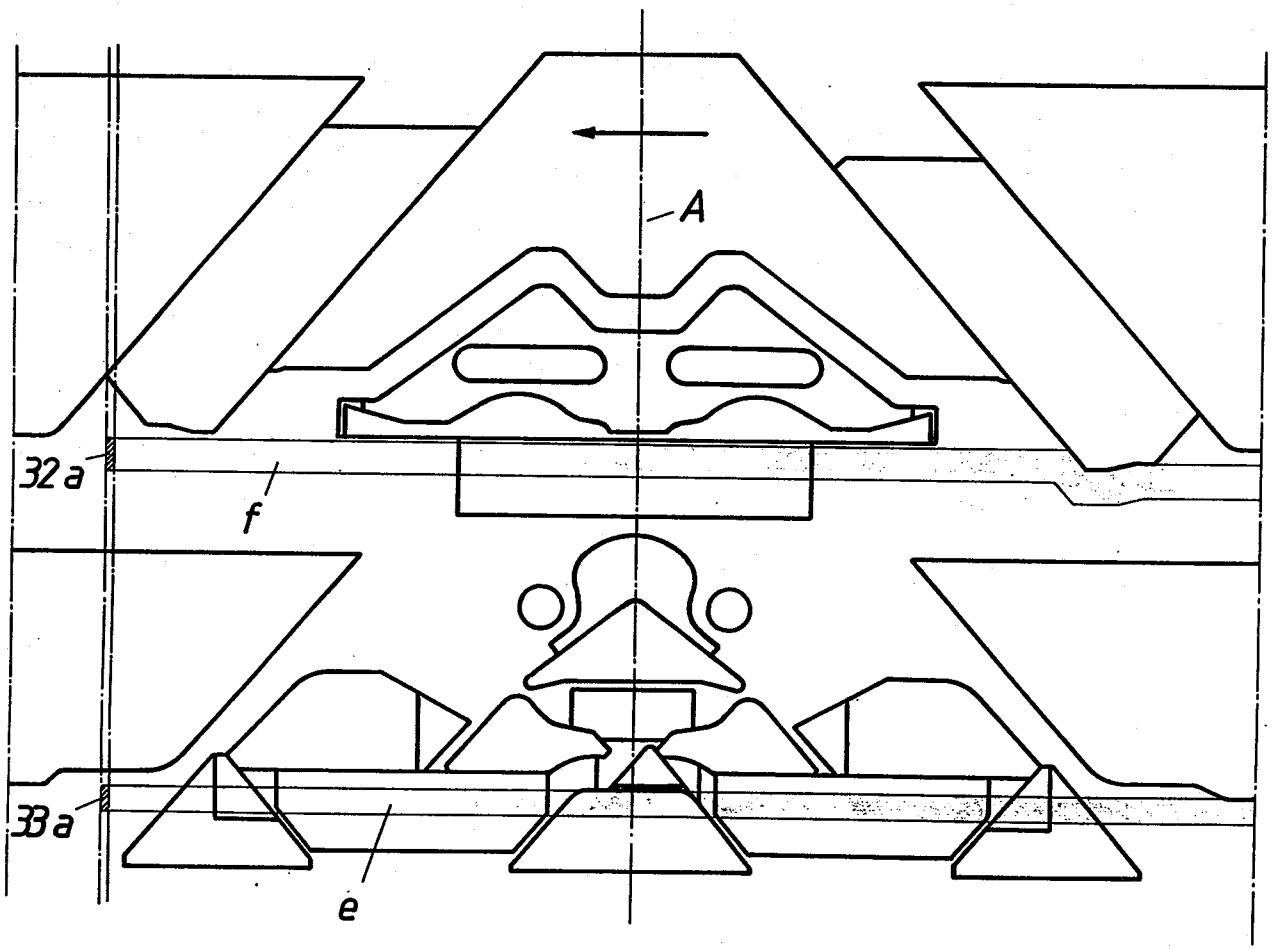
FIG. 8 shows the path of the sinkers and needles out of action on one of the camholders of this second embodiment.

If the sinker is not selected, its butt 33*a* is embedded in the groove of the bed and is not driven by the selection cams, as illustrated in FIG. 8 by the path "e". The butt 32*a* of the associated needle then follows a path "f", that is to say this needle is inoperative.

Figure 9:
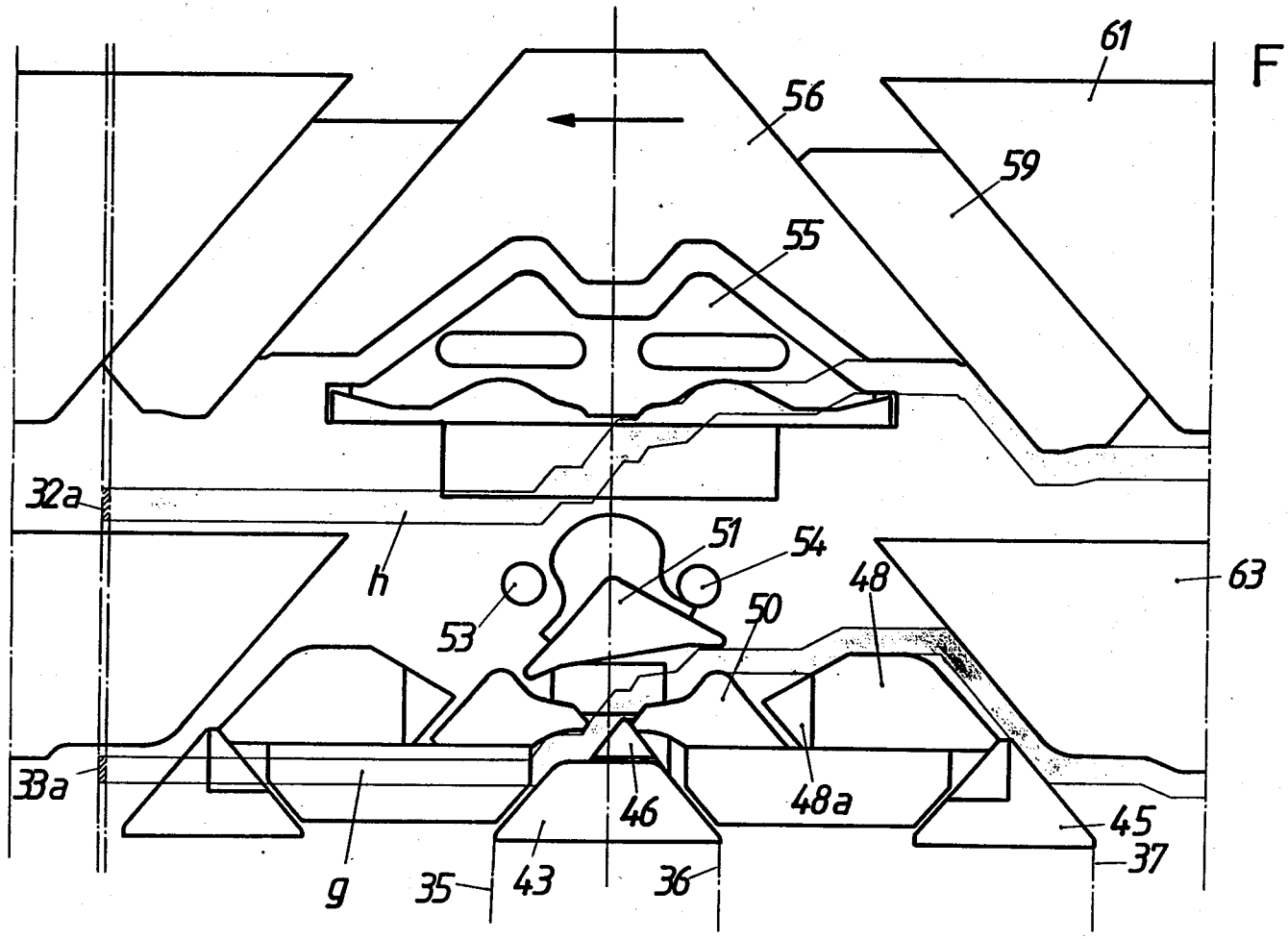
FIG. 9 shows, on the same camholder, the path of the sinkers and needles working at taking-up.

The paths of a sinker and of the associated needle working at taking-up are shown in FIG. 9. In this case, the sinker is selected in front of the central selection cam 43, and its butt 33*a* is lifted by this cam 43 and by the movable cam 46 which it pushes back to the right so as to continue its ascent on the cam 50, moving aside the pivoting cam 51 during its passage. The transfer cam 55 is retractable, so that the butt 32*a* of the needle following the path "h" is not pushed back by the cam 55. The butt of the sinker associated with it from then on does not encounter the oblique slope 48*a* of the taker-up cam 48, but is deflected by this cam 48 according to the path "g". The ascent of the needle is also limited by the cover cam 56. The needle is subsequently picked up by the drop cam 59, whilst the sinker is laid down by the laying-down cam 63. When the carriage moves in the other direction, the cam 46 is pushed to the left and the pivoting cam 51 tilts in the other direction.

Figure 10:
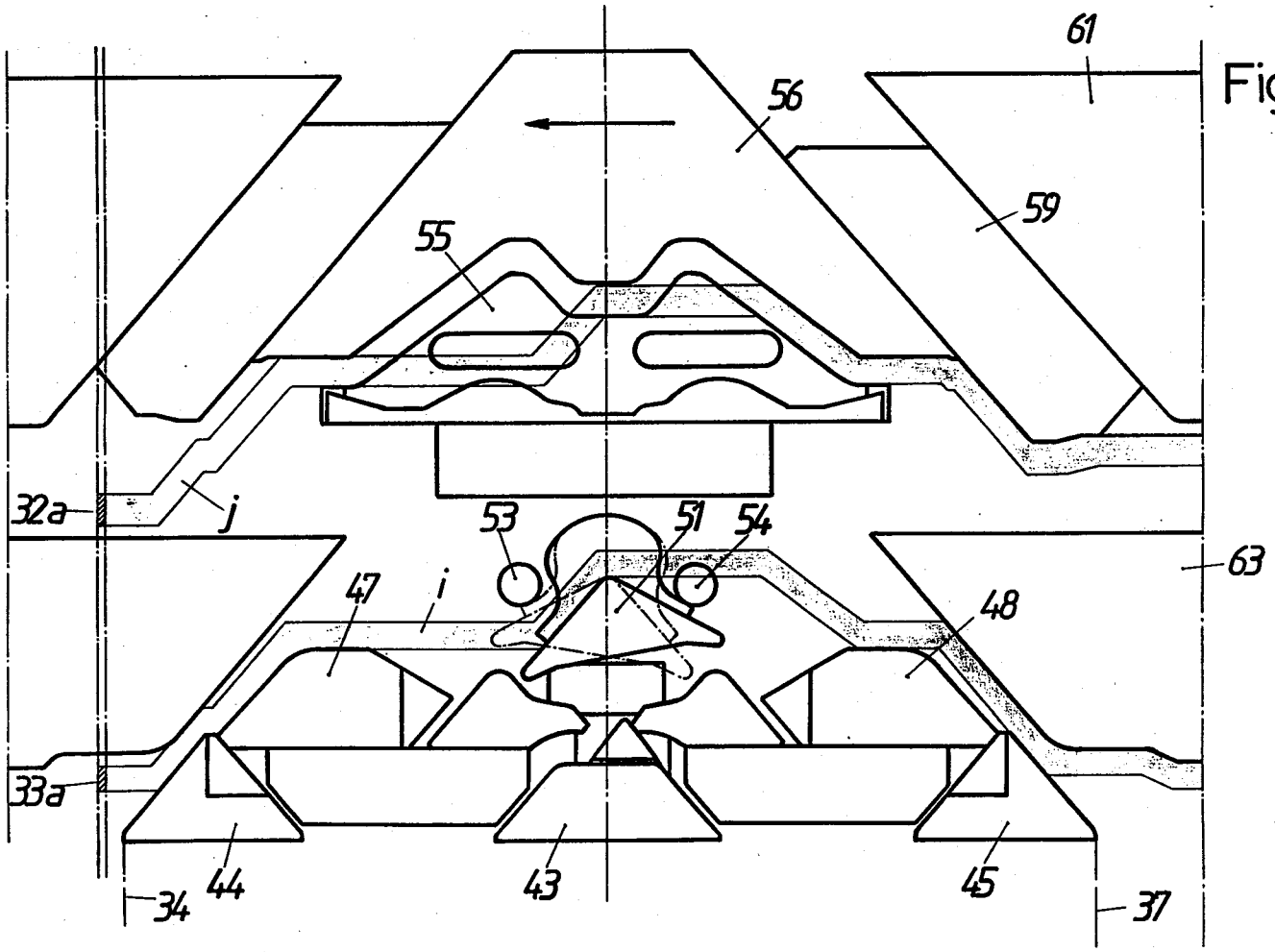
FIG. 10 shows, on the same camholder, the path of the sinkers and needles working at formation.

FIG. 10 illustrates the path "i" of a sinker and the path "j" of the associated needle when a needle is working at formation. In this case, the sinker is selected in front of the selection cam 44 and is lifted by this cam 44 and the taker-up cam 47, at the same time driving the associated needle according to the path "j", the transfer cam 55 being out of action, that is to say retracted. The butt 33*a'* of the sinker meets the oblique left flank of the pivoting cam 51 which pivots up to its stop 54, in such a way that the sinker climbs along this pivoting cam 51, at the same time driving the associated needle which is working at formation. The needle subsequently descends again along the cover cam 56 and then the drop cam 59, thereby driving the sinker which is laid down by the laying-down cam 63.

When the carriage moves in the other direction, the selections take place respectively at 36 for stitch transfer and taking-up and at 37 for formation.

We claim:

1. A camholder for a flat-bed knitting machine, comprising sinker selection cams (14, 15, 16; 43, 44, 45) sinker laying-down cams (23, 24; 62, 63) intended for driving sinkers by means of their butts, and knitting cams (28, 29; 58, 59) and transfer cams (25; 55) intended for driving by means of their butts needles pushed by the selected sinkers, these various cams being designed in such a way that the needles can work at taking-up or at formation or at transfer forwards or backwards in both directions of movement of the camholder, the said camholder being defined in that it possesses at least one section having an axis of symmetry (A) passing through the center of a first central sinker selection cam (14; 43) and through the center of a needle transfer cam (25; 55), this transfer cam (25; 55) being retractable by means of a control device (13) and, with a fixed cam (26; 56), forming a channel (27; 57) for the butts of the needles, the camholder also possessing, on either side of the axis of symmetry (A), another sinker selection cam (15, 16; 44, 45), a retractable taker-up cam (17, 18; 47, 48) and a receiving transfer cam (21, 22; 49, 50), all these retractable cams being arranged between the sinker selection cams, and the taker-up cams being provided with a slope allowing them to be retracted automatically by means of the butts of the selected sinkers, the assembly as a whole being such that it is possible, in one and the same drop, to work at both formation and taking-up and to carry out a stitch transfer forwards or backwards and in both directions of movement of the camholder.

2. The camholder as claimed in claim 1, wherein each section possesses a transversely movable cam (46) capable of moving on either side of the axis of symmetry and a central pivoting cam (51) located above the said central selection cam (43).

3. The camholder as claimed in claim 2, wherein the central selection cam (43) is trapezoidal, and wherein the transversely movable cam (46) is a triangular cam which moves on the small upper base of the central selection cam (43) between the transfer cams (49, 50) under the thrust of the butts of the sinkers.

4. The camholder as claimed in claim 3, wherein the pivoting cam (51) is triangular, and wherein it is mounted pivotally about its apex between two stops (53, 54).

5. The flat-bed knitting machine comprising two opposite beds (1, 2), in which are arranged needles, each associated with a sinker, and a camholder carriage (7) which moves above the beds and which carries, in addition to the camholder, sinker selection means (5, 6) capable of selecting the sinkers individually and at any moment during the movement of the carriage, the camholders comprising sinker selection cams (14, 15, 16; 43, 44, 45), laying-down cams (23, 24; 62, 63) and knitting and transfer cams for the needles (25, 28, 29; 55, 59), all these cams being designed and arranged in such a way that the needles can be out of action or can work at taking-up or at formation or at transfer forwards or backwards in both directions of movement of the carriage, the sinkers being drivable by means of a selection cam at different locations on the camholder when they are selected by the selection means, wherein the camholders possess at least one section having an axis of symmetry (A) passing through the center of a first central sinker selection cam (14; 43) and through the center of a needle transfer cam (25; 55), this transfer cam (25; 55) being retractable by means of a control device (13) and, with a fixed cam (26; 56), forming channel (27; 57) for the butts of the giving needles, the camholder also having, on either side of the axis of symmetry (A), another sinker selection cam (15, 16; 44, 45), a retractable taker-up cam (17, 18; 47, 48) and a receiving transfer cam (21, 22; 49, 50), all these cams being arranged between the selection cams, and the taker-up cams being provided with a slope allowing them to be retracted automatically by means of the butts of the selected sinkers, the assembly as a whole being such that it is possible, in one and the same drop, to work at both formation and taking-up and to carry out a stitch transfer forwards or backwards and in both directions of movement of the carriage. age.

6. The knitting machine as claimed in claim 5, wherein each section of the camholders possesses a transversely movable cam (46) capable of moving on either side of the axis of symmetry and a central pivoting cam (51) located above the said central selection cam (43).

* * * * *

UNITED STATES PATENT AND TRADEMARK OFFICE

CERTIFICATE OF CORRECTION

PATENT NO. : 4,669,280

DATED : June 2, 1987

INVENTOR(S) : Marcello Baseggio et al

It is certified that error appears in the above-identified patent and that said Letters Patent is hereby corrected as shown below:

Column 3, line 25, after "conventional" insert

--knitting or--

Column 3, line 27, after "drop" insert --cam--.

Column 4, line 60, "transfe[cam" should be --transfer cam--

Column 5, line 40, "ams" should be --cams--.

Column 8, line 51, "carriage.age" should be --carriage--.

Signed and Sealed this

Twenty-ninth Day of December, 1987

*Attest:*

DONALD J. QUIGG

*Attesting Officer*

*Commissioner of Patents and Trademarks*